US008695517B2

(12) United States Patent
Kasa

(10) Patent No.: US 8,695,517 B2
(45) Date of Patent: Apr. 15, 2014

(54) QUILTING MACHINE AND IMPROVED DRIVING SYSTEM FOR SUCH QUILTING MACHINE

(76) Inventor: Zoltan Kasa, Dublin, OH (US)

( * ) Notice: Subject to any disclaimer, the term of this patent is extended or adjusted under 35 U.S.C. 154(b) by 388 days.

(21) Appl. No.: 13/163,885

(22) Filed: Jun. 20, 2011

(65) Prior Publication Data

US 2012/0318181 A1 Dec. 20, 2012

(51) Int. Cl.
*D05B 75/00* (2006.01)

(52) U.S. Cl.
USPC ..... 112/117; 112/259; 112/220

(58) Field of Classification Search
USPC ..... 112/2.1, 2, 117, 217.1, 284, 220, 258, 112/259, 260
See application file for complete search history.

(56) References Cited

U.S. PATENT DOCUMENTS

| | | | | | |
|---|---|---|---|---|---|
| 105,548 | A | * | 7/1870 | Chase | 112/258 |
| 112,745 | A | * | 3/1871 | Sidenberg | 112/259 |
| 171,485 | A | * | 12/1875 | Ploss | 112/191 |
| 418,890 | A | * | 1/1890 | Dimond et al. | 112/220 |
| 804,884 | A | * | 11/1905 | Rutan | 248/619 |
| 1,380,758 | A | * | 6/1921 | Webb | 112/11 |
| 1,622,414 | A | * | 3/1927 | Brody | 112/178 |
| 1,789,249 | A | * | 1/1931 | Kelso et al. | 112/258 |
| 1,994,117 | A | * | 3/1935 | Strobel | 112/178 |
| 2,623,486 | A | * | 12/1952 | Scheiwiller | 112/121 |
| 2,774,319 | A | * | 12/1956 | Franklin et al. | 112/176 |
| 2,828,709 | A | * | 4/1958 | Heimann | 112/258 |
| 3,012,532 | A | * | 12/1961 | Leslie | 112/258 |
| 3,168,849 | A | * | 2/1965 | Zilg et al. | 83/628 |
| D205,200 | S | * | 7/1966 | Korenman | D15/69 |
| 4,064,818 | A | * | 12/1977 | Marforio | 112/258 |
| 4,333,410 | A | * | 6/1982 | Taketomi | 112/162 |
| 4,399,762 | A | * | 8/1983 | Hanyu | 112/259 |
| 4,574,718 | A | * | 3/1986 | Scholl et al. | 112/470.18 |
| 4,969,410 | A | * | 11/1990 | Brower et al. | 112/475.19 |
| 4,986,524 | A | * | 1/1991 | Meintzer et al. | 271/100 |
| 5,487,348 | A | * | 1/1996 | Cordes | 112/259 |
| 6,792,884 | B1 | * | 9/2004 | Barrus | 112/475.08 |
| 6,883,446 | B2 | * | 4/2005 | Koerner | 112/272 |
| 7,347,152 | B1 | * | 3/2008 | Wu et al. | 112/259 |

* cited by examiner

*Primary Examiner* — Danny Worrell
(74) *Attorney, Agent, or Firm* — Handal & Morofsky LLC

(57) ABSTRACT

An improved quilting machine, with a housing made by a C-shaped frame that has upper and lower arms, wherein the needle structure at the front end of the upper arm have conventional design (as used in commercial sewing machines) and the bobbin is placed to an elevated height by providing an upwardly extended end portion of the lower arm, wherein an offset shaft transmission means is be provided in the upwardly extended portion that acts as a power transmission towards the bobbin driving axle from the lower driving axle extending in the lower arm, wherein the upper and lower driving axles comprise of hollow drive shafts connected via flexible coupling means to half-shafts mounted on plates that are integral parts of the C-frame by dual ball bearing mounts. By such a simple design the reciprocating mass of the needle structure and the mass of the torque transmission means are reduced, conventional needle moving structures can be used and owing to the lighter load, the dimensions of the drive train can be less massive and heavy.

12 Claims, 3 Drawing Sheets

QUILTING MACHINE AND IMPROVED DRIVING SYSTEM FOR SUCH QUILTING MACHINE

FIELD OF THE INVENTION

The invention relates to quilting machines and to such machines also provided with an improved driving system.

BACKGROUND OF THE INVENTION

My U.S. Pat. No. 7,207,281 deals with quilting machines, more particularly with a drive arrangement for computerized hand-guided quilting device. The basic properties of quilting machines and the way how they can be moved over a fabric to be quilted can be learned.

Further conventional quilting machines are available in the market supplied by Gammill Inc. West Plains (Mo.) having the commercial names of Premier and the Vision Series, and their detailed structures can be found and downloaded from the website of the company: www.gammill.com. The basic design of these prior art quilting machines is described in connection with FIG. 1 at a later part of the present specification, wherein the FIG. 1 also shows the size of a conventional domestic or industrial sewing machine. From FIG. 1 it is clearly visible that the upper surface of the free end portion of the lower arms of the quilting and sewing machine is a planar surface and it defines the bottom of a throat gap, which is just large enough to accommodate the stroke range of the needle. The passage size of the quilting machine is much deeper and higher, therefore the needle structure is arranged in a downwardly projecting front end portion of the upper arm, and a separate needle path extension or guide is provided. Here the needle performs a special alternating movement in the vertical plane, and the movement is transformed from the rotation of an upper drive axle extending along the upper arm of the machine housing, called also as C-frame. The need for the vertical extension has increased the mass of the vertically moving elements, and with higher mass, the driving axle is exposed to higher loads and to the vibration effect of such reciprocal movement. While the C-frame of the quilting machine is substantially larger and heavier compared to that of the conventional sewing machines, the accuracy requirements on the needle-bobbin alignment are the same. In case of larger distances and masses, it is rather difficult to ensure the same degree of precision. These problems have been solved by using a highly reinforced and massive C-frame with high weight and size, and the upper and lower axles extending along the full arm lengths have been made by massive solid shafts of also extended size. With such dimensions, any imbalance in the rotating masses can cause misalignment, and the load acting on the arms of the C-frame tend to excite vibration which also contributes to misalignment.

OBJECT OF THE INVENTION

The main object of the invention is to provide an improved quilting machine, wherein there is no need for extending the path of the reciprocating needle structure. A further object lies in the further reduction of the rotating masses and in providing an increased precision concerning the alignment of the needle and the bobbin which allows substantial reduction of the mass of the supporting C frame.

SUMMARY OF THE INVENTION

According to a first aspect of the invention it has been recognized that to meet the need of extended passage depth and height, not the needle structure should be lowered to provide the required throat gap so that the bobbin remains in the plane of the lower arm, but conversely, the upper arm structures should retain their conventional designs (as used in commercial sewing machines) and the bobbin should be placed to an elevated height by providing an upwardly extended end portion of the lower arm, wherein an offset shaft transmission means should be provided in the upwardly extended portion to provide transmission towards the bobbin driving axle from the lower driving axle extending in the lower arm. By such a simple design the reciprocating mass of the needle structure is reduced, conventional structures can be used and owing to the lighter load, the dimensions of the drive train can be less massive and heavy.

According to a further aspect of the invention it has been realized that the long upper and lower driving axles need not be made by a solid rod material, they can be made of hollow tubes designed for transmitting torque, and the short shafts can be made as half shafts coupled to the hollow axles by means of respective resilient connecting members. Here the precision is provided by the short half-shafts connected by double bearings to plates forming integral units with the C-frame. This structure substantially reduces the overall mass of the C-frame and of the axles, providing thereby a structure less sensitive against vibration and which is easy to handle owing to the reduced weight and size.

DESCRIPTION OF THE DRAWINGS

The invention will now be described in connection with preferable embodiments thereof, wherein reference will be made to the accompanying drawings. In the drawing.

DETAILED DESCRIPTION OF THE PREFERRED EMBODIMENTS

Figure 1:
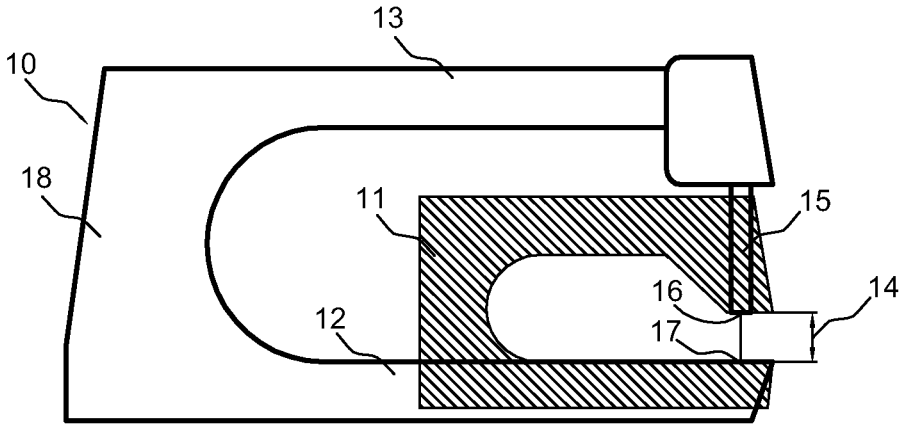
FIG-1 PRIOR ART
FIG. 1 shows schematically a prior art quilting machine also indicating a conventional sewing machine.

FIG. 1 shows schematically a conventional quilting machine 10 in such a way that a hatched area illustrates the contour lines of a conventional domestic or industrial sewing machine 11. The basic difference between the sewing machine 11 and the quilting machine 10 lies in that while the fabric is moved under the needle of the sewing machine 11, in case of the quilting machine 10 the fabric is stretched on a frame (not shown) and the stitching mechanism with the machine 10 is moved around over the fabric.

To maximize the space that can be quilted in a pass, the throat depth of quilting machines like the machine 10 has been enlarged from the typical size of 8 to 12 inches at a sewing machine 11 to the range of about 18 to 30 inches. The quilted portion of the fabric is rolled up on a take-up roller (not shown). More particularly, the quilting machine 10 comprises an extended lower arm 12 and an extended upper arm 13 providing together an expanded throat length. The lower and upper arms 12 and 13 house the bobbin and needle rotating axles, respectively.

To accommodate the rolled-up fabric, the height of the throat of the quilting machine 10 has been enlarged from the typical 4 to 6 inches of sewing machines 11 to the range of 8 to 12 inches in a way as shown in FIG. 1. In both types of machines 10 and 11, a throat gap 14 (typically in the range of 2 to 3 inches) illustrated by an arrow in FIG. 1 is formed between head and throat plates 16, 17 of the machine which is just large enough to accommodate the stroke range of the needle. As shown in FIG. 1 the gap 14 has the same size at the conventional sewing machine 11 as at the quilting machine 10 so that the common height of the throat plate 17 has been retained. The required increase of the height of the throat was provided in the machine 10 by arranging the head with the upper arm 13 higher and retaining the original height of the lower arm 12. This change required the use of longer needle bars than what is used in the sewing machine 11. To stabilize the longer needle bars, a separate needle guide 15 was added that has the additional task of stabilizing the needle bar by embedding multiple bushings/bearings. By this arrangement the same gap size 14 could be retained for the needle stroke as in case of the domestic/industrial sewing machine 11.

The body or housing of the quilting machine 10 has a massive C-shaped frame often called as C-frame that has the lower and upper arms 12, 13 and support column 18 connecting the rear ends of the arms 12, 13. The C-shaped frame has the main functional task of keeping the needle and the bobbin aligned and to accommodate all mechanisms required for the correct operation. Even minute changes in the alignment will cause imperfect stitch formation. Larger displacement between the needle and the bobbin may result in needle breakage. The extension of the C-frame at the quilting machine 10 compared to the conventional sewing machine 11 has increased the mass of the moving parts of the machine.

Figure 2:
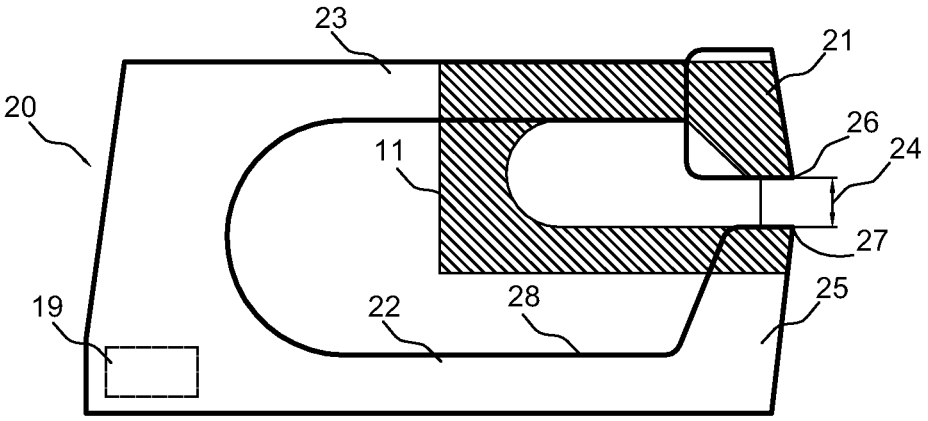
FIG. 2 is a view similar to FIG. 1 showing the quilting machine according to the present invention.

For eliminating these drawbacks and their structural and functional consequences as already described, according to the present invention the design of the quilting machine 10 of the prior art has been changed substantially to take the shape of the quilting machine 20 as shown in FIG. 2. The hatched area symbolizes again a conventional sewing machine 11. In this preferred quilting machine 20 the upper arm 23 and the needlebar structure therein have the same height and design as those of the upper arm in the conventional sewing machine 11. At the front (open) end of the upper arm 23 a downwardly extended portion 21 is provided which houses the needlebar structure just as in case of the conventional sewing machines 11. The lower arm 22 has been sunk to the required extent to provide the necessary throat height. At the front (open) end of the lower arm 22 an upwardly extended portion 25 is provided which houses the bobbin and the mechanism required for its rotation, that includes a bobbin axle. This change has offset the axle of the bobbin from the bobbin driving axle inside the lower arm 22, and has required the use of per-se known offset-shaft transmission means (which will be described at a later part of the present description). In this way the same sized throat gap 24 has been retained between the head and the throat plates 26, 27 of the machine 20 as in case with the conventional sewing machine 11. Inside the housing a drive motor 19 can be arranged, which is illustrated in FIG. 20 by dashed lines.

The increase of the height of the throat plate 27 relative to upper surface 28 of the lower bar 22 has numerous advantages. One of them will be that the plane of the fabric held by its stretching frame has become elevated from the lower bar 22, eliminating the friction between the bottom of the fabric and the upper surface 28.

The main advantage, however, will be the use of the same short needle bar structure as in case of the conventional sewing machine 11, whereby all of the listed problems caused by the need of using the separate needle guide 15 have been eliminated. The increasing of the height of the bobbin is not connected with additional technical difficulties, as the mass of the bobbin is small, and the means for providing its required motion have not become more complex or connected with technical problems by offsetting the height of the bobbin axle from the driving axle inside the lower arm 22.

The internal design of the quilting machine 20 as shown in FIG. 2 can be made in any of the conventional ways, however, according to a further aspect of the present invention substantial further advantages can be achieved if the functions of holding the structural weight including the provision of the required structural strength are separated from the way how the machine is driven, i.e. how the driving force is transmitted from the driving motor to the needle and bobbin, respectively.

Figure 3:
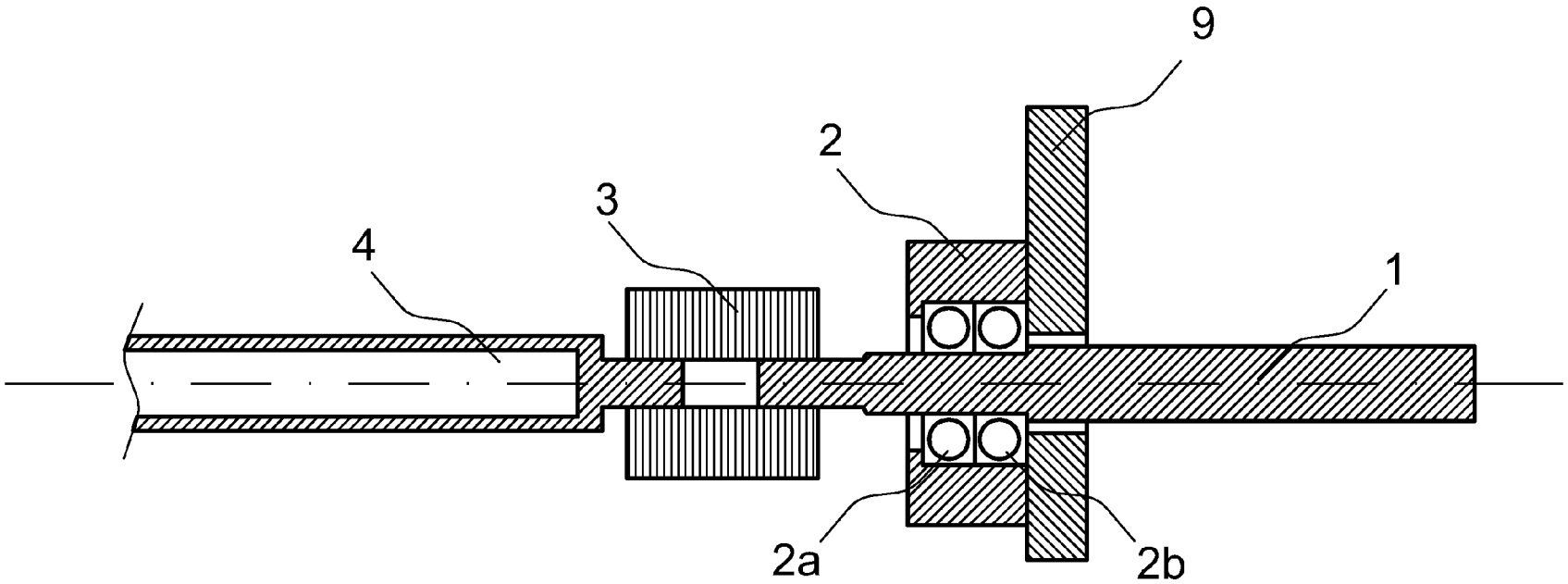
FIG. 3 shows an enlarged detail of a hollow axle coupled to a half shaft by flexible connection.

Such an exemplary solution will be described in connection with FIGS. 3 and 4. First, it should be mentioned that the most dominant rotating components of the quilting machine 20 (and also of conventional quilting machines 11) are constituted by the needle and bobbin drive axles. The term "dominant" designates here that such axles are the heaviest, longest and functionally most important components. It has been recognized that the main role of such axles is to transmit the rotation from the driving motor to the remote ends of the respective arms of the C-frame, and this transmission job has become more difficult in the quilting machine 20 having extended arm lengths because the sensitivity of the needle-bobbin system against any alignment error has remained the same. The increased length has brought about greater mass, greater problems of any non-balancing of the mass distribution and higher demand of precision as to the accurate axis alignment. Furthermore, the enlarged C-frame is exposed to higher loads, and in operation the forces acting on the working ends of the arms cause the arms vibrate, and the C-frame has to be designed to be insensitive against such outer excitations. This requirement demands the use of still higher-mass and stronger frames.

The novel approach to such problems has been the separation of the transmittance of torque from one end of the axles (arms) to their other ends so that this cannot require any further increase in the rigidity and mass of the C-frame. This separation can be solved by the application of two measures, namely the use of appropriately designed hollow axles instead of the conventional rod-like solid axles, and to create a certain degree of freedom concerning the alignment of the axles.

It is a well known fact that a rotating axle transmits the torque mostly close to its outer surface, therefore the massive axles used up to the present can be replaced by appropriately designed hollow drive axles. The main requirement for these axles is that they should have minimum deformation when twisting forces are applied thereon. As examples, aluminum alloy or carbon-fiber tubes can be used. A hollow drive axle will provide torque transmission at a considerably lower mass, but it is too flexible to maintain solid alignment with the required accuracy. The proposed arrangement has separated the transmission and alignment functions by using the drive train shown in FIG. 3. A portion of such a hollow drive axle 4 is shown in FIG. 3. The components (e.g. bobbin, drive motor, etc.) which require precise alignment are in connection with respective half-shafts 1 that are mounted in ball bearing mounts 2 containing double ball bearings (or double-race single bearings) 2*a*, 2*b*, respectively. The bearing mount 2 is solidly mounted and fixed on respective mounting plates 9 being integral part of the C-frame. This arrangement keeps the components mounted and connected to the half-shaft 1 precisely aligned and forming an integral mechanical unit with the C-frame, and allowing free rotation of the half-shaft 1. In order to compensate for any alignment error caused by any angular positioning error of the hollow drive axle 4, the half-shaft is connected to the hollow drive axle 4 through a flexible coupling device 3 which has sufficient flexibility to take up slight alignment errors. Of the several various types of flexible couplers those with very low deformation under twisting forces, for example helical couplers, should be used. FIG. 3 shows a helical spring used as coupling device 3.

By solving the separation task, the benefits of such an arrangement include:

- the considerably low mass of the drive axle has minimum or no impact on the C-frame, even if it is misaligned, flexing, etc;
- the half-shaft 1 solidly mounts the respective components to the C-frame; and
- the angular and offset tolerance of the flexible coupler 3 reduces the manufacturing accuracy requirements for concentricity, angular displacement and do not cause misalignment of the bearing mounts 2 and of the half-shaft 1.

Figure 4:
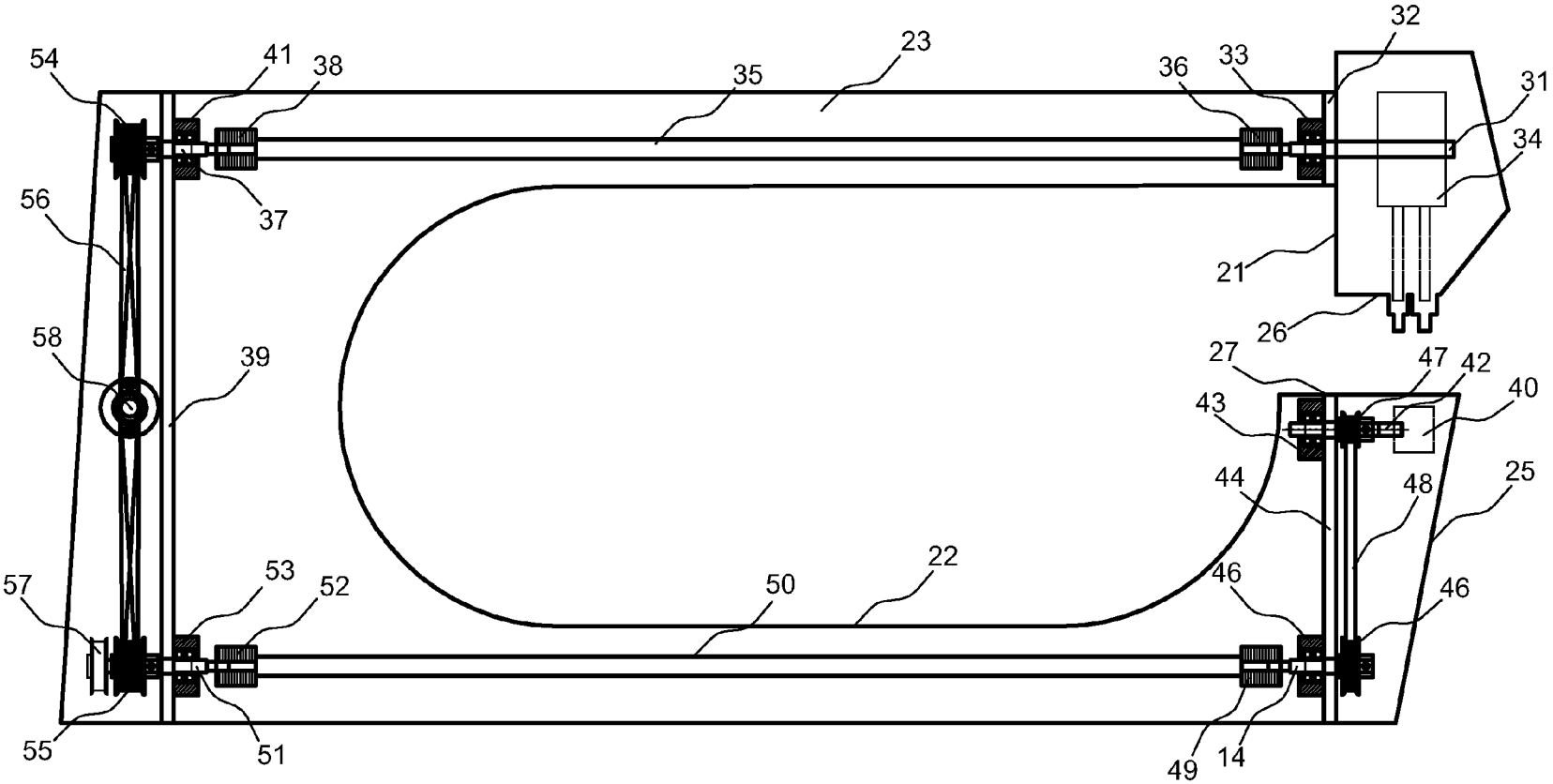
FIG. 4 shows schematically the drive train of the present quilting machine.

The full drive train arrangement of the quilting machine 20 is shown on FIG. 4. Half-shaft 31 is mounted on plate 32 on the upper arm 23 of the C-frame by dual ball bearing mount 33 similar to that shown in FIG. 3. The half shaft 31 drives a conventional needlebar structure (illustrated by dashed lines) 34 arranged in the downwardly extending portion 21. The driven end of the half-shaft 31 is connected to a first end of needle drive axle 35 through flexible coupler 36. The second end of the needle drive axle 35 is connected to half-shaft 37 through a further flexible coupler 38. The half-shaft 37 is mounted on a vertically extending rear plate 39 by dual ball bearing mount 41. The front and rear plates 32 and 39 are integral parts of the C-frame.

Inside the upwardly extended portion 25 of the C-frame and close to bobbin 40 a bobbin driving half-shaft 42 is mounted by dual ball bearing mount 43 on a front plate 44 which is part of the C-frame that allows rotation thereof. Downwardly offset from the half shaft 42 a further half-shaft 45 is mounted on the front plate 44 by dual ball bearing mount 46.

In a preferable embodiment the required transmission between the half-shafts 42 and 45 is provided by a timing belt drive, consisting of respective lower and upper timing belt pulleys 46 and 47, connected together with the a single sided timing belt 48. In this embodiment the front transmission provides the required 2 to 1 rotation ratio between the bobbin 40 and the lower drive axle.

The driven end of the half-shaft 45 is connected to one end of lower drive axle 50 through flexible coupler 49.

The other (driven) end of the lower drive axle 50 is connected to a further half-shaft 51 through flexible coupler 52. The half-shaft 51 is mounted on the rear plate 39 of the C-frame by dual ball bearing mount 53.

In the exemplary embodiment of FIG. 4 the transmission between the upper and lower half-shafts 37, 51 is provided by a timing belt drive, consisting of lower and upper timing belt pulleys 54, 55, connected together with a single sided timing belt 56. In this embodiment the known twisted timing belt arrangement is used, in order to provide the required reversed rotation between the upper and lower drive axles 35, 50. To prevent the two sides of the twisted timing belt 56 from touching, an idler roller 58 is used.

In another preferred embodiment the transmission between the upper and lower half-shafts 35, 50 can be provided by a double-sided timing belt arrangement.

From the point of view of correct operation it is indifferent where a drive motor 19 (FIG. 2) is connected to the drive train. One possible embodiment is when the drive motor 19 is connected to the lower half-shaft 51 using a second pulley 57 placed thereon connected to a pulley on the drive motor shaft by a synchronous (timing) or asynchronous (V-belt) belt (not shown).

It should be noted that the use of hollow axles in combination with flexible couplers and half-shafts mounted by ball-bearings to support plates integral with the C-frame can well be used in conventional quilting machines designed as shown in FIG. 1, however, the advantages will be more apparent when the two aspects of the present invention are united in a single improved quilting machine.

In summary, the present invention provides a number of unexpected benefits compared to the prior art solutions described schematically in FIG. 1. Here the C-frame and especially its arms determine predominantly the weight and rigidity of the machine because the combined mass of the moving parts have been substantially reduced by means of using light hollow axles and by eliminating the need of the use of a separate needle guide 15. The expected result is decreased vibration and better needle-bobbin alignment at an overall lower mass of the machine.

In any case the most visible difference between the proposed arrangement and the known machine designs is that the proposed arrangement keeps the length of the needlebar the same as the domestic/industrial sewing machines. This is done by dropping the bobbin drive axle below the level of the throat plate. This arrangement keeps the mass and geometry of the components with stroking movements the same as in the domestic/industrial machines.

Further benefits come from the design shown, including but not limited to:

- by reducing the mass of the moving parts of the longarm machine, the alignment function of the C-frame become unaffected by the moving parts;
- owing to the decreased mass of the moving parts the required power of the drive motor is reduced;
- the lower inertia of the moving parts makes motion control easier;
- the vibration of the machine is greatly reduced;
- the overall mass of the machine is reduced, making it easier for the operator to move it around; and
- the elevation of the plane of the fabric from the upper surface of the lower arm has provided an increased freedom for the quilting machine.

What is claimed is:

1. A longarm quilting machine, comprising: a housing constituted by a substantially C-shaped frame, said frame having an upper arm extending substantially in horizontal direction and having two ends, a lower arm extending substantially in horizontal direction and having two ends and an upper surface; and a substantially vertical support column interconnecting one of said ends of said arms; respective upper and lower driving axles extending within and along said upper and lower arms, wherein said upper and lower arms and said column together define a throat passage; a motor rotating said axles; a downwardly extending portion connected to the other end of said upper arm; a needlebar structure arranged in said downwardly extending portion; an upwardly extending portion connected to said other end of said lower arm; a bobbin with a bobbin driving axle arranged in said upwardly extending portion; said downwardly and upwardly extending portions have respective head and throat plates defining a throat gap between them whereby said throat plate is positioned above said upper surface of said lower arm, said throat gap having a size substantially not more than 3 inches; wherein said bobbin axle is vertically spaced from said lower driving axle; and further comprising a transmission device in said upwardly extending portion to rotate said spaced bobbin driving axle by the rotation of said lower driving axle.

2. The quilting machine as claimed in claim 1, wherein said throat passage has a depth in the range between 18 to 30 inches.

3. The quilting machine as claimed in claim 1, wherein said throat passage has a height in the range between 8 to 12 inches.

4. The quilting machine as claimed in claim 1, wherein said throat gap being at least 2 inches.

5. The quilting machine as claimed in claim 1, wherein each of said upper and lower axles being hollow axles having two ends, and the machine further comprises respective half-axles having two ends mounted by means of respective ball bearings to respective associated mounting plates forming mechanically integral part of said housing; and respective flexible couplers designed to transfer torque and to connect said hollow axle ends with one end of an associated one of said half-shafts; the other ends of said half shafts being used to drive said needlebar structure, said bobbin or being driven by said driving motor.

6. The quilting machine as claimed in claim 5, wherein said flexible couplers being helical springs.

7. The quilting machine as claimed in claim 5, wherein said ball bearings being dual ball bearing mounts or double-race single bearings.

8. The quilting machine as claimed in claim 5, wherein said hollow axles being made of aluminum alloy tubes or of carbon fiber tubes.

9. A driving system for a quilting machine, wherein said machine has a rigid C-shaped housing and comprising a needle structure; a bobbin; a driving motor; an upper and a lower driving axle both of said axles having two ends and designed as hollow shafts; respective half-axles with two ends, each half-axle being associated with and coupled to one of said ends of said driving axles; and respective flexible couplers providing said coupling between an end of said axles with an end of said associated half-axle; mounting plates forming mechanically integral part of said housing; ball bearings each connecting one of said half-axle with an associated one of said mounting plates; and said other ends of said half-axles being coupled to drive said needle structure, said bobbin and being driven by said driving motor, respectively.

10. The driving system as claimed in claim 9, wherein said flexible couplers being helical springs.

11. The driving system as claimed in claim 9, wherein said ball bearings being dual ball bearing mounts or double-race single bearings.

12. The driving system as claimed in claim 9, wherein said hollow axles being made of aluminum alloy tubes or of carbon fiber tubes.

* * * * *